US005183624A

United States Patent [19]

Brückner et al.

[11] Patent Number: 5,183,624

[45] Date of Patent: Feb. 2, 1993

[54] SHUTOFF ASSEMBLY AND IMPROVED DRIVE ROD THEREFOR

[75] Inventors: Raimund Brückner, Engenhahn; Ullrich Hintzen, Taunusstein-Watzhahn, both of Fed. Rep. of Germany; Steve Lee, Donbartonshire, Scotland; Andreas Schuler, Taunusstein-Wehen; Martin Wiesel, Wiesbaden, both of Fed. Rep. of Germany

[73] Assignee: Didier-Werke AG, Wiesbaden, Fed. Rep. of Germany

[21] Appl. No.: 774,229

[22] Filed: Oct. 10, 1991

[30] Foreign Application Priority Data

Oct. 10, 1990 [DE] Fed. Rep. of Germany ..... 4032083

[51] Int. Cl.[5] ..... B22D 41/18

[52] U.S. Cl. ..... 266/236; 222/598; 222/602

[58] Field of Search ..... 222/598, 599, 602; 266/236

[56] References Cited

U.S. PATENT DOCUMENTS

| | | | |
|---|---|---|---|
| 117,918 | 8/1871 | Ostrander | 222/602 |
| 5,037,017 | 8/1991 | Lührsen et al. | 222/598 |

FOREIGN PATENT DOCUMENTS

| | | |
|---|---|---|
| 2922666 | 10/1980 | Fed. Rep. of Germany . |
| 3731600 | 6/1989 | Fed. Rep. of Germany . |
| 3743383 | 7/1989 | Fed. Rep. of Germany . |
| 88/04209 | 6/1988 | World Int. Prop. O. . |

*Primary Examiner*—Scott Kastler

*Attorney, Agent, or Firm*—Wenderoth, Lind & Ponack

[57] ABSTRACT

A shutoff and/or control assembly for use in regulating the discharge from a metallurgical vessel includes a refractory ceramic rotor member to be coupled to a stator to be rotated relative thereto to control discharge. A drive rod has an inner end extending into the rotor member and engaging therewith such that rotation of the drive rod causes rotation of the rotor member. At least an inner end portion of the drive rod is formed of a ceramic material.

30 Claims, 2 Drawing Sheets

SHUTOFF ASSEMBLY AND IMPROVED DRIVE ROD THEREFOR

BACKGROUND OF THE INVENTION

The present invention relates to a shutoff and/or control assembly for use in regulating the discharge of molten metal from a metallurgical vessel. More particularly, the present invention relates to such an assembly including a refractory ceramic rotor member to be mounted on and coupled to a stator so that the rotor member is rotatable relative to the stator to control discharge of the molten metal, and a drive rod having an outer end to be connected to and rotated by a drive unit and an inner end extending into the rotor member and coupled to and engaging therewith such that rotation of the drive rod causes rotation of the rotor member. The present invention also is directed to a novel and improved drive rod for use in such an assembly.

A shutoff and control device of this general type is disclosed in WO 88/04209 and is advantageous in that the assembly or device is constructed to enable the drive rod to tilt relative to the control rotor member. Thus, errors in alignment in the axial direction between the drive rod and the rotor member are accommodated, therefore avoiding the previous potential disadvantage of jamming during operation. Such assembly has the further advantage that the rotor member itself is not rotated by the drive unit, and therefore the rotor member is not subjected over the entire axial length thereof to a rotary torque. In total, the kinematics of this construction during operation are advantageous.

However, such known construction has certain disadvantages. Particularly, the drive rod is positioned within the shutoff and control rotor member by means of an end ball and socket-type arrangement. As a result, the rotor member is not subjected to flexural forces during drive. The rotor member can be raised and lowered by the drive rod and also can be rotated thereby. However. as a practical matter the transfer of rotation to the rotor member is complex in design and has a negative impact on the ability of the drive rod to tilt or incline relative to the rotor member.

A similar shutoff and control device is disclosed in German DE 37 43 383 A1. In this assembly, the shutoff and control rotor member only is raised or lowered by the control rod, and is not rotated thereby. However, in this arrangement also the drive rod engages with the shutoff and control rotor member by means of a ball-socket connection located deeply within the rotor member, almost to a position adjacent the outlet opening or openings in the rotor; member.

In such prior art assemblies, the drive rods are formed of metal. It has been found however that this is a disadvantageous arrangement since the molten metal located externally of the rotor member generates a very high temperature in the interior of the rotor member. As a practical matter, such a condition requires that the metal drive rod be cooled. Such cooling however is time consuming and can lead to dangerous conditions in the event of a failure of the assembly. Additionally, the metal drive rod undergoes a relatively high degree of thermal expansion, and this also is disadvantageous.

SUMMARY OF THE INVENTION

With the above discussion in mind, it is an object of the present invention to provide an improved shutoff and/or control assembly of the above general type, but improved to overcome the above and other prior art disadvantages.

It is a further object of the present invention to provide an improved drive rod for use in such an assembly.

The above and other objects of the present invention are achieved by an arrangement whereby at least an inner end portion of the drive rod is formed of a ceramic material. This feature in accordance with the present invention provides substantial advantages over prior art arrangements. Particularly, the drive rod, or at least the portion thereof in engagement with the rotor member, maintains a constant shape, even in the high temperature environment prevailing within the interior of the rotor member. As a result, cooling of the drive rod no longer is necessary. Additionally, thermal expansion of the ceramic material of the drive rod is comparatively low and does not significantly deviate from the thermal expansion of the refractory ceramic material of the rotor member itself. As such, it is not necessary to compensate for varying degrees of thermal expansion between such two members.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
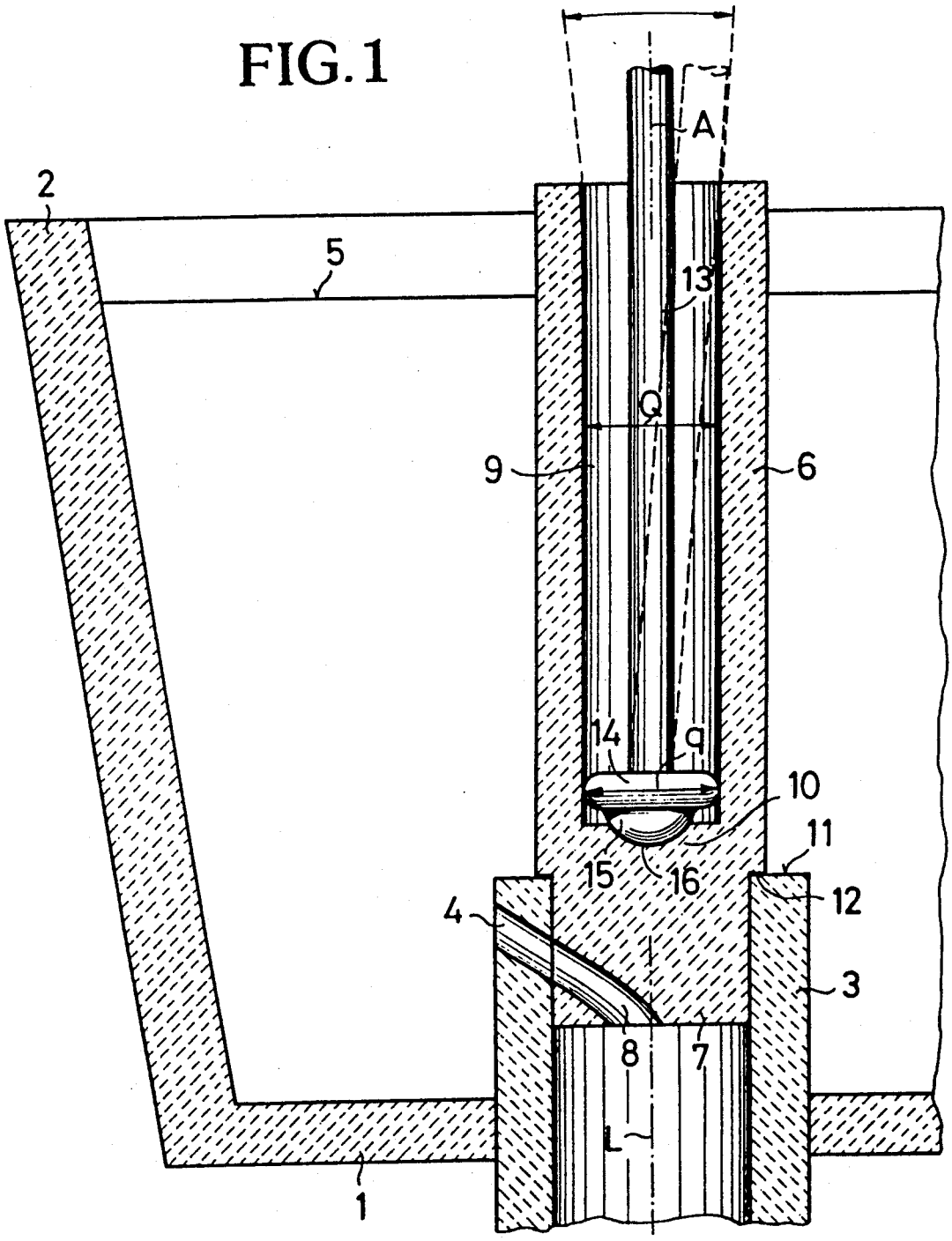
FIG. 1 is a schematic cross-sectional view through a discharge area of a metallurgical vessel equipped with an assembly in accordance with a first embodiment of the present invention.

Shown schematically in FIG. 1 is a metallurgical vessel 2 containing molten metal having an upper level 5. Mounted within a bottom 1 of the metallurgical vessel is a cylindrical outlet stator member 3 having therein a lateral opening 4. A refractory ceramic shutoff and control rotor member 6 is mounted within stator 3 for rotation relative thereto. A bottom region 7 of rotor member 6 extends into the stator member 3 and has therethrough an opening 8 that can be brought into and out of alignment with opening 4 by rotation of rotor member 6 around its longitudinal axis L. Rotor member 6 has externally thereof a step 12 abutting on an upper edge 11 of stator member 3.

The axial length or height of rotor member 6 is such that the upper end thereof is above level 5. Above bottom region 7 the rotor member 6 is provided with a hollow interior 9 that is open upwardly and that is closed at its bottom at a base 10. In the illustrated arrangement, the base 10 is positioned above stepped surface 12 at the outer circumference of the rotor member 6. However, it also is possible to provide base 10 deeper within the rotor member, i.e. as far as below step 12.

A drive rod 13 extends into interior 9 and has an upper, outer end to be coupled to a drive unit (not shown) by which drive rod 13 can be rotated about its longitudinal axis A.

In the embodiment of FIG. 1, an inner end portion of drive rod 13 includes a transfer element for transferring rotation of drive rod 13 to rotor member 6. This transfer element is in the form of a transfer block 14 having a non-circular cross-sectional configuration and mating with a complementary non-circular cross-sectional configuration of interior 9. The inner end of drive rod 13 furthermore has a cup-shaped protrusion 15 that fits within and is received in a concave recess 16 formed in base 10. The drive rod 13 is received in interior 9 due to protrusion 15 fitting in recess 16 with the intended alignment being that the axis A of the drive rod is coincident with axis L of the rotor member. However, in the event that such coincident alignment is not possible, for example due to dimensional errors, etc., the part spherical configuration of protrusion 15 and recess 16 enable the drive rod 13 to tilt relative to the rotor member 6, as indicated by dashed lines in FIG. 1. Thus, dimensional errors or errors between the position of the drive unit and the position of the rotor member 3 are compensated by enabling the drive rod to tilt in this manner with respect to the rotor member.

The interior 9 has a transverse cross-sectional configuration Q that is non-circular, for example square, polygonal or oval. Transfer block 14 has a complementary cross-sectional configuration q. As a result, transfer block 14 fits within interior 9 and is joined thereto in a form-locking manner with regard to the axes L, A, so that when drive rod 13 is rotated, such rotation is transferred by transfer block 14 to rotor 6. The transfer block 14 is provided with an arched or rounded configuration at upper and lower ends thereof, as shown in FIG. 1, so that tilting of the drive rod and transfer block relative to the rotor member is allowed.

In the embodiment of FIG. 1, at least transfer block 14 is formed of a refractory ceramic material, for example $ZrO_2$ or SiC ceramic. Also, the protrusion 15 can be formed of such material. Additionally, the entire drive rod, including transfer block 14 and protrusion 15 can be formed of such ceramic material, for example formed as a one-piece integral component. As a result, the drive rod 11, and particularly the transfer block 14, will have approximately the same coefficient of thermal expansion as will the ceramic material of the rotor member 6. Therefore, the two components will not expand at substantially different rates or by substantially different amounts. The drive rod 13, and at least the transfer block 14, maintains a constant shape at the high temperatures prevailing in the interior 9 without additional effort. Cooling of the drive rod is not necessary. Also, the drive rod of the invention can continue to be employed after the rotor member 6 has become worn and has to be replaced. Thermal expansion of the transfer block 14 in directions radially of longitudinal axis A are, at the most, very small and in any case will not be greater than the thermal expansion of the rotor member 6 in this region. As a result, there is no danger of the rotor member 6 being damaged by a relatively outwardly expanding drive rod.

Figure 2:
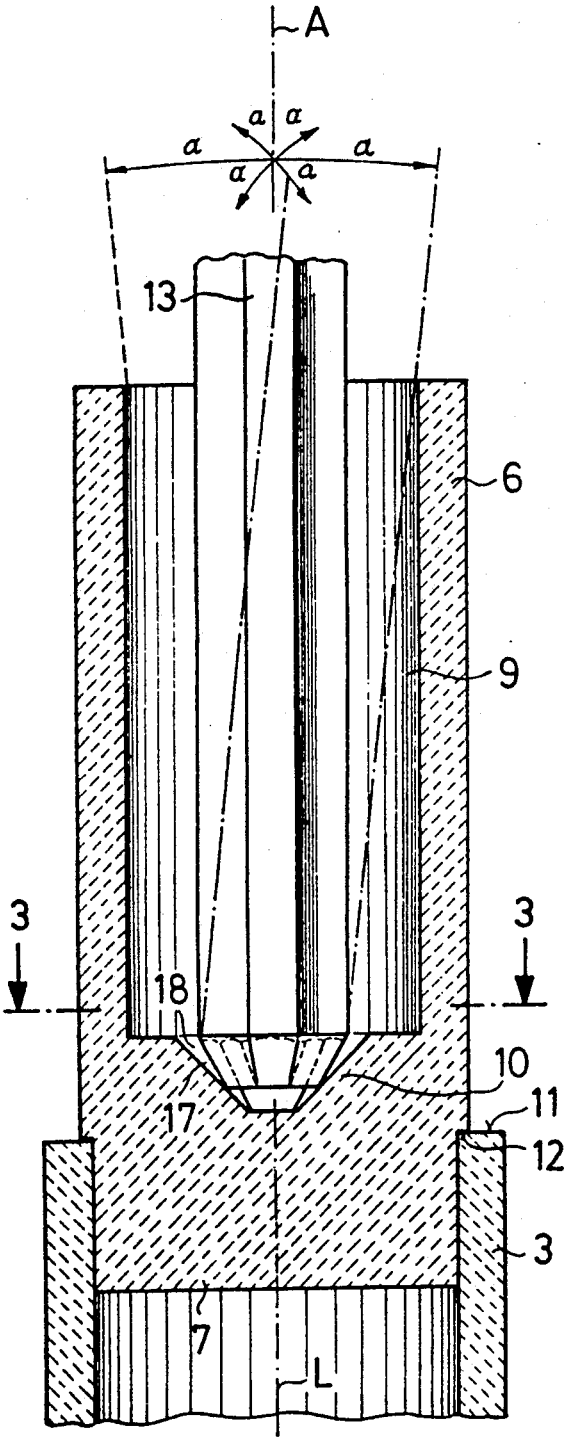
FIG. 2 is a cross-sectional view of another embodiment according to the present invention, taken along line 2—2 of FIG. 3.
Figure 3:
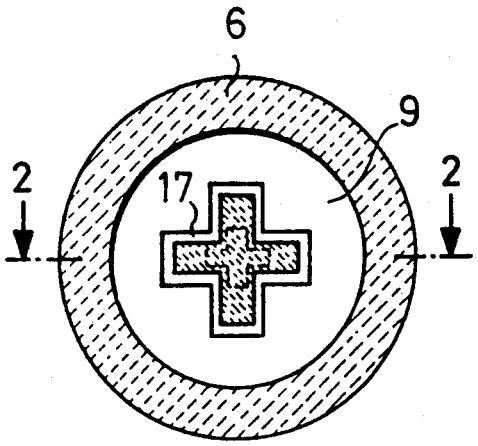
FIG. 3 is a transverse cross-sectional view taken along line 3—3 of FIG. 2.

In the embodiment of FIGS. 2 and 3, the base 10 of the interior 9 has formed therein a depression or recess 17 that conically tapers downwardly and that has a cross-sectional configuration that is cruciform. Drive rod 13 has a conically tapered lower or inner end, having a degree of conicity less than that of the degree of conicity of the recess 17. This provides a free space 18 illustrated in FIG. 2 and enables the drive rod 3 to tilt relative to the rotor member 6. In the illustrated arrangement, the entire length of drive rod 13 has a cruciform cross-sectional configuration. This is not entirely necessary, as long as the inner end thereof has a configuration that is complementary to that of recess 17. The cruciform inner end of the drive rod fits within the cruciform recess 17, thereby forming a twist-proof connection therebetween so that rotation of the drive rod is transmitted to the rotor member. In this arrangement, the configuration of the interior 9, other than recess 17, is circular.

The cruciform configuration allows the relative angular displacements $\alpha$ of the drive rod relative to the rotor member illustrated in FIG. 2.

The drive rod, or at least the inner end portion thereof engaging with the rotor member, may be formed of the refractory ceramic materials indicated above, and additionally can be made of a ceramic material based on $Al_2O_3$ and $Si_3N_4$. The drive rod can be manufactured in an advantageous manner by means of slip casting, continuous casting or isostatic pressing as would be understood by one skilled in the art. In so doing, both solid shapes and hollow shapes can be formed.

Although the present invention has been illustrated and described with regard to preferred features thereof, it is to be understood that various modifications and changes may be made to the specifically described and illustrated features without departing from the scope of the present invention.

We claim:

1. In a shutoff or control assembly for use in regulating the discharge from a metallurgical vessel and including a refractory ceramic rotor member to be coupled to a stator to be rotatable relative thereto to control discharge, and a drive rod separate from said rotor member and having an outer end to be connected to and rotated by a drive unit and an inner end portion extending into said rotor member and having engagement means engaging with an interior portion of said rotor member such that rotation of said drive rod causes rotation of said rotor member, the improvement wherein:

at least said engagement means of said inner end portion of said drive rod is formed of a ceramic material.

2. The improvement claimed in claim 1, wherein substantially said entire drive rod is formed of said ceramic material.

3. The improvement claimed in claim 1, wherein said ceramic material of said drive rod and the ceramic material of said rotor member have substantially the same coefficient of thermal expansion.

4. The improvement claimed in claim 1, wherein said ceramic material comprises $ZrO_2$ or SiC.

5. The improvement claimed in claim 1, wherein said ceramic material is based on $Al_2O_3$ or $Si_3N_4$.

6. The improvement claimed in claim 1, wherein said engagement means of said inner end portion of said drive rod engages with and is shaped approximately complimentarily to said interior portion of said rotor member.

7. The improvement claimed in claim 6, wherein t least said interior portion of said rotor member and said engagement means of said inner end portion of said drive rod have non-circular cross-sectional configurations.

8. The improvement claimed in claim 7, wherein said engagement means of said inner end portion of said drive rod comprises a transfer block having a non-circular periphery engaging said interior portion of said rotor member.

9. The improvement claimed in claim 8, wherein the interior of said rotor member has a base having a recess formed therein, and said inner end of said drive rod has a protrusion fitting within said recess.

10. The improvement claimed in claim 9, wherein said protrusion and said recess have complementary partial spherical shapes.

11. The improvement claimed in claim 9, wherein said protrusion is located inwardly of said transfer block.

12. The improvement claimed in claim 9, wherein said protrusion is formed of said ceramic material.

13. The improvement claimed in claim 7, wherein the entire interior of said rotor member is of said non-circular cross-sectional configuration.

14. The improvement claimed in claim 7, wherein the interior of said rotor member has a base having therein a depression having said non-circular cross-sectional configuration, and said engagement means of said inner end portion of said drive rod has a shape matching and fitting into said depression.

15. The improvement claimed in claim 14, wherein said interior of said rotor member other than said depression has a circular configuration.

16. The improvement claimed in claim 14, wherein said depression and said inner end portion of said drive rod are conically tapered.

17. The improvement claimed in claim 16, wherein the degree of conicity of said depression is greater than that of said inner end portion of said drive rod.

18. The improvement claimed in claim 14, wherein said cross-sectional configuration is cruciform.

19. In a drive rod to be employed with a refractory ceramic rotor member to form a shutoff or control assembly for use in regulating the discharge from a metallurgical vessel, said drive rod having an outer end to be connected to and rotated by a drive unit and an inner end portion to extend into the rotor member and including engagement means to engage an interior portion of the rotor member to transmit rotation thereto, the improvement wherein:

at least said engagement means of said inner end portion of said drive rod is formed of a ceramic material.

20. The improvement claimed in claim 19, wherein substantially said entire drive rod is formed of said ceramic material.

21. The improvement claimed in claim 19, wherein said ceramic material comprises $ZrO_2$ or SiC.

22. The improvement claimed in claim 19, wherein said ceramic material is based on $Al_2O_3$ or $Si_3N_4$.

23. The improvement claimed in claim 19, wherein said engagement means of said inner portion of said drive rod comprises a transfer block having a non-circular periphery.

24. The improvement claimed in claim 23, wherein said inner end of said drive rod has a protrusion to fit within a recess in the rotor member.

25. The improvement claimed in claim 24, wherein said protrusion has a partial spherical shape.

26. The improvement claimed in claim 24, wherein said protrusion is formed of said ceramic material.

27. The improvement claimed in claim 19, wherein said inner end portion of said drive rod is conically tapered.

28. The improvement claimed in claim 19, wherein said inner end portion of said drive rod has a non-circular cross-sectional configuration.

29. The improvement claimed in claim 28, wherein said cross-sectional configuration is cruciform.

30. The improvement claimed in claim 1, wherein said rotor member and said drive rod have respective longitudinal axes, and said drive rod is tiltable within the interior of said rotor member such that said longitudinal axis of said drive rod may be inclined to said longitudinal axis of said rotor member.

* * * * *